US005933970A

United States Patent [19]

Diresta

[11] Patent Number: 5,933,970

[45] Date of Patent: Aug. 10, 1999

[54] POWERED TOY HAND DRAWING DEVICE

[75] Inventor: James Diresta, Woodmere, N.Y.

[73] Assignee: 4Kidz, Inc., Stamford, Conn.

[21] Appl. No.: 08/888,988

[22] Filed: Jul. 7, 1997

[51] Int. Cl.[6] ..... B43L 13/00; B43K 19/00

[52] U.S. Cl. ..... 33/27.01; 33/18.1; 33/27.09; 33/27.11

[58] Field of Search ..... 33/27.01, 18.1, 33/18.2, 27.06, 27.09, 27.11; 446/3, 71, 236

[56] References Cited

U.S. PATENT DOCUMENTS

| | | | |
|---|---|---|---|
| 2,707,831 | 5/1955 | Rial et al. | 33/27.01 |
| 3,297,003 | 1/1967 | Benson | 33/27.11 |
| 3,390,460 | 7/1968 | Brown et al. | 33/27.01 |
| 3,861,077 | 1/1975 | Lindquist | 33/27.11 |
| 3,997,972 | 12/1976 | Jaunarajs | 33/18.1 |
| 4,211,012 | 7/1980 | Alles et al. | 33/18.1 |
| 4,419,041 | 12/1983 | Rose | 33/27.11 |
| 4,835,874 | 6/1989 | Ellman et al. | 33/27.11 |
| 5,208,987 | 5/1993 | Christen | 33/18.1 |
| 5,433,642 | 7/1995 | Chia | 446/71 |

*Primary Examiner*—Christopher W. Fulton
*Attorney, Agent, or Firm*—Robert W.J. Usher

[57] ABSTRACT

A powered hand drawing device in which a pen is mounted in a barrel casing and operably connected through an eccentric to an electrc motor which rotates a writing tip to describe a related figure on a writing surface. The pen is removably mounted in a tubular holder carried by a fulcrum formed by a swivel joint comprising a ball having a diametrical, pen holder receiving bore and a pair of rings secured together entrapping the ball in swivelling relation between them. The barrel wall has two, opposed longitudinal slots and finger-pieces extend from one of the rings through respective slots thereby mounting the the fulcrum for manual sliding adjustment along the barrel (and pen holder) to alter an amplitude of the orbital movement of the writing tip and the figures described.

7 Claims, 1 Drawing Sheet

FIG. 1
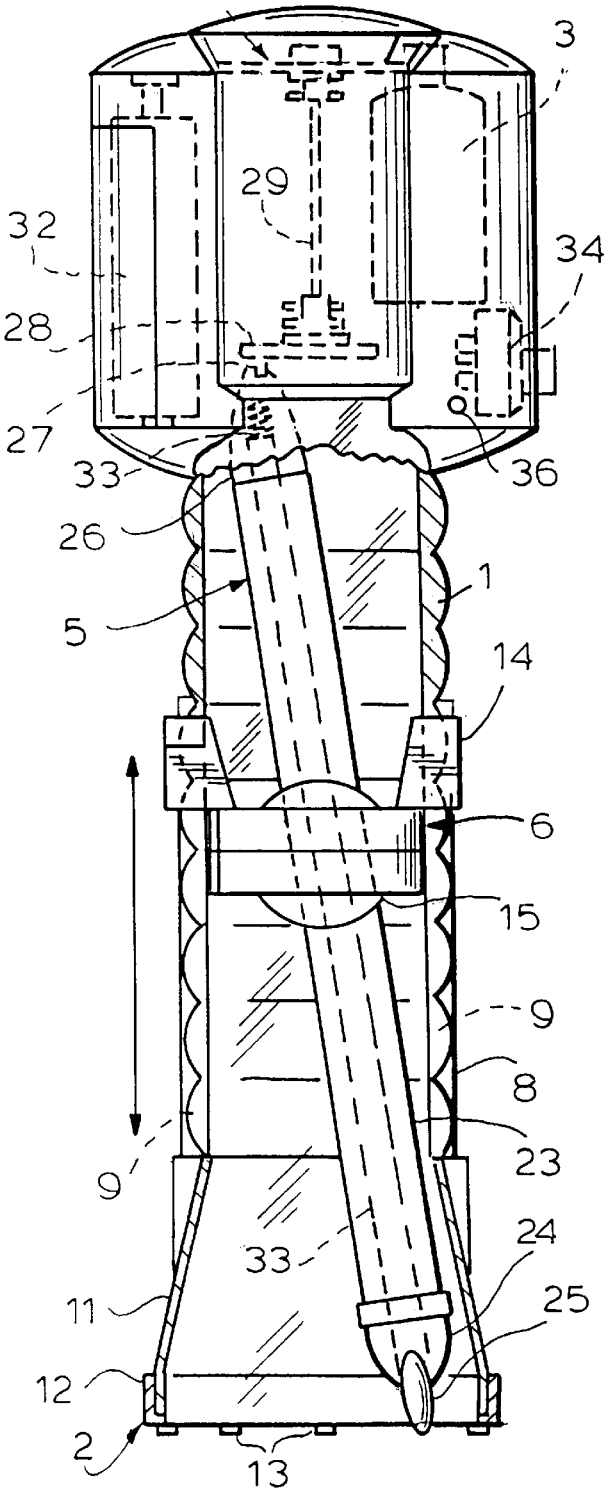
FIG. 2
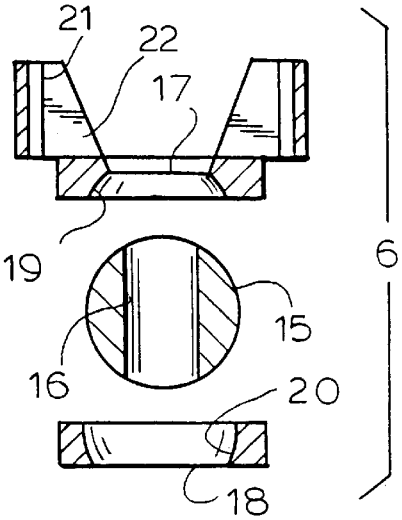
FIG. 3
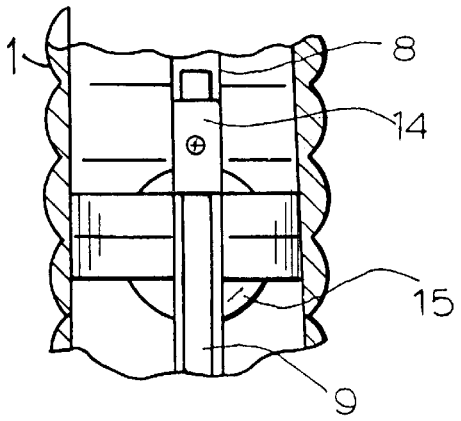
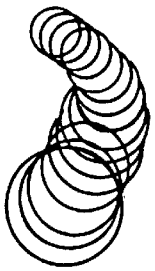
FIG. 4

POWERED TOY HAND DRAWING DEVICE

FIELD OF THE INVENTION

The invention relates to a powered toy hand drawing device for marking surfaces with patterns such as loops, circles, or spirals.

BACKGROUND OF THE INVENTION

A variety of powered toy hand drawing devices for marking patterns have been proposed over many years for amusement and decorating purposes.

U.S. Pat. No. 3,297,003 issued to Benson in 1967, teaches one type of powered toy hand drawing device comprising an elongate, manually grippable, pen-receiving casing or barrel having an open, writing end; rotary drive means mounted to an opposite end; and means for movably supporting a pen within the barrel with a writing tip of the pen protruding from the writing end and an opposite end of the pen eccentrically driven by the rotary drive means and, fulcrum means encircling the pen at a location between the opposite end and the writing end so that operation of the rotary drive means produces oscillation or circular movement of the writing tip, enabling looping or helical patterns to be drawn by moving the writing tip across a writing surface.

A disadvantage of the known device is that, as a consequence of the fulcrum means being constituted by a fixed constriction in the wall of the casing or barrel, the amplitude of movement of the writing tip can only be altered by changing a tip confining end piece mounted on the open end of the casing. In the absence of the end piece, circles described by the tip will all be of the same size.

An additional disadvantage of the prior device follows from the requirement for the body of the pen to directly engage the drive means and the fulcrum means apparently limiting use to a single type of pen precisely matched in length and cross-section.

U.S. Pat. No. 4,835,874 issued in 1989 to Ellman teaches a powered toy hand drawing device which relies on the forces from an eccentric mass mechanism to produce periodic motion while the user's fingers provide a a fulcrum means with consequential difficulties in control.

Other examples of powered toy hand drawing devices are taught by U.S. Pat. No. 3,390,460 issued in 1968 to Brown; U.S. Pat. No. 5,433,642 issued in 1995 to Chia; U.S. Pat. No. 3,997,972 issued in 1976 to Jaunarais.

U.S. Pat. No. 3,861,077 issued in 1975 to Lindquist teaches a toy marking device constituted by a spinning top and U.S. Pat. No. 4,419,041 issued in 1993 to Rose teaches a relatively complex spacial mechanism for replacing articulated arm structures of robotic devices.

SUMMARY OF THE INVENTION

An object of the invention is to provide a powered toy hand drawing device of the type described above in which the amplitude of periodic movement of the writing tip can be readily altered by the user while retaining a relatively simple construction which is adapted for economic production at high volume using conventional mass production techniques for supply to the consumer at relatively low cost.

A further object of the invention is to provide a drawing device of such type which can, within limits, accommodate different types and sizes of pens.

According to one aspect of the invention, in a device of the type described, the barrel has an external wall portion formed with a slot extending longitudinally away from the writing end and the fulcrum means includes a fingerpiece extending through the slot thereby mounting the fulcrum means for manual adjustment along the slot toward and away from the writing end to alter an amplitude of movement of the writing tip and sizes of circles described.

Thus, the longitudinal positions of adjustment can either be preselected to describe circles, loops, helixes etc of different, predetermined, sizes or the longitudinal position of the fulcrum means may be adjusted during drawing to produce spiral figures.

Preferably, the barrel is a one-piece injection molded part and the fulcrum means is a swivel joint comprising a ball having a diametrical, pen receiving bore and a pair of rings connected to the fingerpiece and secured together in coaxial relation trapping the ball in swivelling relation between them.

It is also preferred that the pen supporting means comprises a pen holding tube slidably received in the bore and having an open, pen insertion end and an opposite, blind end eccentrically connected to the drive means, a biasing spring being mounted in the blind end and the insertion end tapering and being provided with stiffly resilient pen gripping fingers for resilient flexure apart by forcible engagement with the non-writing end of a pen to admit and retain the pen in the holding tube gripped between the biasing spring and the pen gripping fingers.

Thus, pens of different thicknesses, cross-sectional shapes, (e.g. circular or hexagonal), and lengths can, within limits, determined largely by the degree of resilient flexure of the biassing spring and fingers, be used in the device of the invention. This enables users to select from a variety of pens likely to be in their possession. The ready substitution of pens of different colors enables differently colored spirals and other decorative figures to be drawn, increasing the variety and attractiveness of the artwork.

It will be understood that the term pen embraces any suitable writing instrument such as a pencil, solid or fluid ink device.

BRIEF DESCRIPTION OF THE DRAWINGS

In order that the invention may be readily understood, a specific embodiment thereof will now be described by way of example only and with reference to the accompanying drawings in which:

FIG. 1 is a diagrammatic elevational view, partly in cross-section of the powered toy hand drawing device according to the invention;

FIG. 2 is an exploded view of the fulcrum mechanism thereof;

FIG. 3 is a diagrammatic fragmentary view of the fulcrum mechanism; and,

FIG. 4 shows a spiral form of a type possibly obtained using the device.

DESCRIPTION OF PARTICULAR EMBODIMENT

The toy hand drawing device comprises an elongate, manually grippable, pen-receiving casing or barrel 1 having an open, writing end 2; a rotary motor 3 mounted to an opposite end and a pen-holding tube 5 eccentrically coupled to the motor at a blind end and mounted in the barrel intermediate its ends by a fulcrum 6 so that operation of the motor produces circular movement of the writing tip, enabling either circles or looping/helical patterns to be drawn by moving the writing end across a writing surface.

The barrel 1 is injection molded in one piece of transparent plastic with a transversely corrugated, external wall portion 7, and a pair of diametrically opposed longitudinal slots 8 surrounded by a rim 9. The barrel diverges at a writing end to form a conical portion 11, a base of which is seated in a reinforcing collar 12. Writing surface engaging feet 13 are adhered to a bottom of the collar at perimetrically spaced apart locations. The conical portion 11 enables the maximum radius of orbital movement of the writing tip to be accommodated and locates the device stably in a correct upright writing position during while facilitating controlled manipulation during use. The feet reduce sliding friction facilitating smooth and easy movement across a writing surface.

The fulcrum 6 comprises a plastic ball 15 having a diametrical, tube receiving bore 16 and upper and lower plastic retaining rings 17 and 18, having inner surfaces 19, 20, respectively, profiled to conform with the ball surface and bonded together in coaxial relation, trapping the ball in swivelling relation between them. Diametrically opposite portions of the upper ring 17 are formed with fingerpieces 14 having grooves 21 slidably receiving opposite edges of the slots 9 and connected to the upper ring by respective wing portions 22 thereby mounting the fulcrum means for manual positional adjustment along the slot toward and away from the writing end to alter the amplitude of the orbital movement of the writing tip and sizes of figures described.

The pen-holding tube 5 has a substantially rigid central body portion 23 slidably received in the bore 16 and an open, pen insertion end fitted with a tapering cap 24 slotted to form stiffly resilient pen gripping fingers 25. An opposite end of the body portion is also fitted with a cap 26 mounting a biassing spring 33 and receiving a screw 27 eccentrically mounted for rotation on a disk 28 which is driven by the motor via spindle 29 and reduction gear 30. The power source for the motor is battery 32.

The pen gripping fingers can be flexed apart by engagement with a non-writing end of a typical ball point pen to admit and retain the pen in the holding tube, gripped between the biasing spring and the pen gripping fingers.

The cone locates the spirolator upright in the correct upright position on the paper. In practice, the writing tip may normally protrude beyond the base of the cone by a distance of (approximately ¼ inch according to spring stiffness) so that the spring will provide a suitable writing pressure as a result of its axial compression when the cone base is located on a writing surface. Flexural tolerances of the biassing spring and pen gripping fingers enable pens of different lengths and thicknesses to be accommodated within limits. The corrugations of the barrel increase strength and facilitate gripping by the user, while the user can both view the writing tip and figures through the transparent cone during operation, facilitating accuracy of the figures described.

The device can, when stationary, be used to draw circles, or, when slid across the writing surface, helixes of preselected sizes by manually locating the fulcrum position in different positions of adjustment along the slots or, by moving the fulcrum during operation, a variety of spirals similar to that of FIG. 4.

A scale and indents can be provided along the slots to enable the fulcrum to be held reliably in preselected fixed positions to enable circles of predetermined radius to be drawn more accurately.

In addition to conventional power slide switch, a "momentary on" button switch 36 may also be provided mainly for trial drawing purposes.

It will be appreciated that the device has relatively few parts that can be manufacted economically by conventional mass production techniques for supply to the consumer at relatively low cost.

I claim:

1. A powered toy hand drawing device of a type comprising an elongate, manually grippable, pen-receiving casing or barrel having an open, writing end; rotary drive means mounted to an opposite end; and means for movably supporting a pen within the barrel with a writing tip of the pen protruding from the writing end and an opposite end of the pen eccentrically driven by the rotary drive means and, fulcrum means encircling the pen at a location between the opposite end and the writing end so that operation of the rotary drive means produces orbital movement of the writing tip to describe a related figure on a writing surface, wherein the barrel has an external wall portion formed with a slot extending longitudinally away from the writing end and the fulcrum means includes a fingerpiece extending through the slot thereby mounting the fulcrum means for manual positional adjustment along the slot toward and away from the writing end to alter an amplitude of the orbital movement of the writing tip and sizes of figures described.

2. A device according to claim 1 wherein the fulcrum means is a swivel joint comprising a ball having a diametrical, pen receiving bore and a pair of rings connected to the fingerpiece and secured together entrapping the ball in swivelling relation between them.

3. A device according to claim 1 wherein the pen supporting means comprises a pen holding tube slidably received in the fulcrum means and having an open, pen insertion end and an opposite, blind end eccentrically connected to the drive means, a biasing spring being mounted in the blind end and the insertion end tapering and being provided with stiffly resilient pen gripping fingers for resilient flexure apart by a pen to admit and retain the pen in the holding tube gripped between the biasing spring and the pen gripping fingers.

4. A device according to claim 2 wherein the pen supporting means comprises a pen holding tube slidably received in the bore and having an open, pen insertion end and an opposite, blind end eccentrically connected to the drive means, a biasing spring being mounted in the blind end and the insertion end tapering and being provided with stiffly resilient pen gripping fingers for resilient flexure apart by forcible engagement by a pen to admit and retain the pen in the holding tube gripped between the biasing spring and the pen gripping fingers.

5. A device according to claim 1 wherein the external wall portion of the barrel is formed with a series of transverse corrugations.

6. A device according to claim 1 wherein the writing end of the barrel diverges to provide a divergent, rigid, transparent, writing surface engaging cone.

7. A device according to claim 6 wherein friction reducing, writing surface engaging feet are provided at spaced apart intervals around a free end of the cone.

* * * * *